US009101002B2

(12) United States Patent
Lin

(10) Patent No.: US 9,101,002 B2
(45) Date of Patent: Aug. 4, 2015

(54) METHOD OF CONTROLLING MULTIPLE LAMPS

(71) Applicants: HEP TECH CO., LTD., Taichung (TW); Ming-Feng Lin, Taichung (TW)

(72) Inventor: Ming-Feng Lin, Taichung (TW)

(73) Assignees: HEP TECH CO., LTD., Taichung (TW); Ming-Feng Lin, Taichung (TW)

( * ) Notice: Subject to any disclaimer, the term of this patent is extended or adjusted under 35 U.S.C. 154(b) by 0 days.

(21) Appl. No.: 14/483,878

(22) Filed: Sep. 11, 2014

(65) Prior Publication Data

US 2015/0077012 A1 Mar. 19, 2015

(30) Foreign Application Priority Data

Sep. 18, 2013 (TW) ..... 102133890 A

(51) Int. Cl.
*H05B 37/02* (2006.01)
*H05B 33/08* (2006.01)

(52) U.S. Cl.
CPC ..... *H05B 37/02* (2013.01); *H05B 33/0809* (2013.01); *H05B 37/0272* (2013.01); *H05B 33/0815* (2013.01)

(58) Field of Classification Search
USPC ..... 315/149–160, 209 R, 291, 185 S
See application file for complete search history.

(56) References Cited

U.S. PATENT DOCUMENTS

| | | | | |
|---|---|---|---|---|
| 7,633,406 | B2 * | 12/2009 | Miki | 340/9.1 |
| 8,842,009 | B2 * | 9/2014 | Jones | 340/541 |
| 8,981,912 | B2 * | 3/2015 | Talstra et al. | 340/12.23 |
| 2014/0085108 | A1 * | 3/2014 | Clifford et al. | 340/908.1 |
| 2014/0117875 | A1 * | 5/2014 | Kane | 315/291 |

* cited by examiner

*Primary Examiner* — Tuyet Vo
(74) *Attorney, Agent, or Firm* — WPAT, PC; Justin King

(57) ABSTRACT

A method of controlling multiple lamps is applied to an illumination system, which includes an input interface, a signal transmitter, a plurality of signal receivers, a plurality of driving devices, and a plurality of lamps. The method includes the following steps: detect a state of the input interface with the signal transmitter; transmits a corresponding signal with the signal transmitter; each of the signal receivers receives the signal and detects a waveform of an AC power source, and each of the signal receivers transmits a corresponding control signal to the corresponding driving device to control the corresponding lamp at a reference point in the following cycle of the waveform of the AC power source.

9 Claims, 5 Drawing Sheets

METHOD OF CONTROLLING MULTIPLE LAMPS

The current application claims a foreign priority to the patent application of Taiwan No. 102133890 filed on Sep. 18, 2013.

BACKGROUND OF THE INVENTION

1. Technical Field

The present invention relates generally to illumination systems, and more particularly to a method of controlling multiple lamps.

2. Description of Related Art

Conventionally, an illumination system of multiple lamps includes an input interface provided at a control terminal, a signal transmitter, a plurality of signal receivers provided at a load terminal, a plurality of driving devices, and a plurality of lamps, wherein the input interface is electrically connected to the signal transmitter, the signal receivers are electrically connected to the signal transmitter, and the signal receivers are sequentially connected to each driving device and each lamp. When a user controls the lamps through the input interface, the signal transmitter accordingly transmits a signal to the signal receivers, and each signal receiver then transmits a corresponding control signal to each driving device to control the connected lamp.

However, a signal receiver is composed of electronic components, which may cause time bias for sending signals due to differences of manufacturing process, temperature, interfering noises among the electronic components, or even due to unstable voltage, and each lamp may be operated at different time point as a result, especially when the luminance of the lamps is repeatedly changed by the driving devices under control of the signal receivers. With longer time or more times of changing the luminance, the difference of the luminance among the lamps may become more obvious, and therefore the lamps are unable to maintain an even luminance together.

BRIEF SUMMARY OF THE INVENTION

In view of the above, the primary objective of the present invention is to provide a method of controlling multiple lamps, which makes multiple lamps operate simultaneously.

The present invention provides a method of controlling multiple lamps, which is applied to an illumination system including an input interface, a signal transmitter, a plurality of signal receivers, a plurality of driving devices, and a plurality of lamps, wherein the signal transmitter is electrically connected to the input interface, and communicates with the signal receivers; the signal receivers are electrically connected to an AC power source, and each of the signal receivers are electrically connected to each of the driving devices and each of the lamps one by one; the method comprising the following steps: A. detect a state of the input interface with the signal transmitter; B. transmit a signal according to the detected state of the input interface from the signal transmitter to the signal receivers; and C. receive the signal and detect a waveform of the AC power source with each of the signal receivers, and then transmit a corresponding control signal to the corresponding driving device at a reference point in a cycle of the waveform of the AC power source, wherein each of the driving devices controls the corresponding lamps accordingly, and the reference point in each cycle of the waveform of the AC power source is the same.

Whereby, the method can make multiple lamps to be operated simultaneously, which effectively eliminates uneven luminance.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
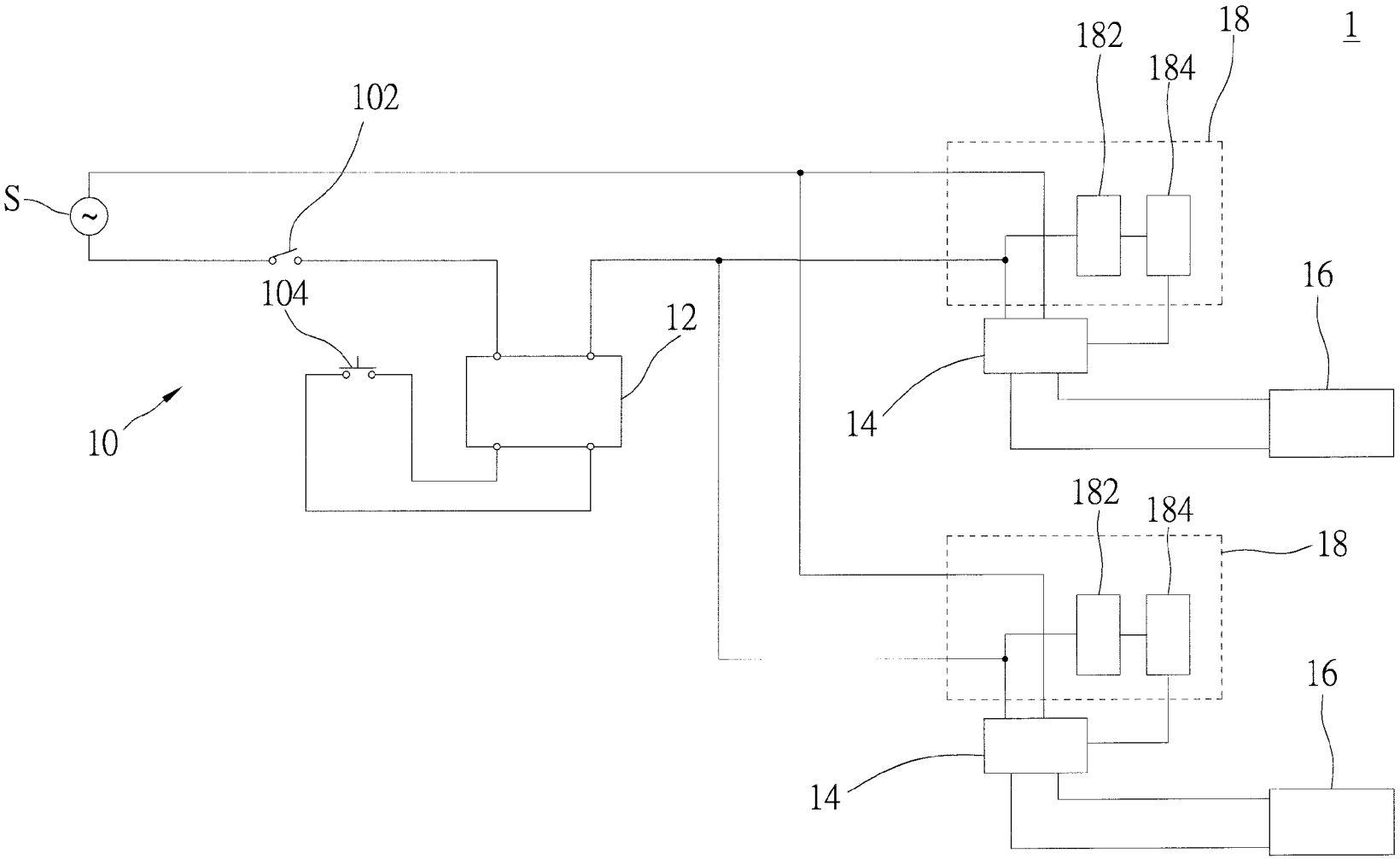
FIG. 1 is a schematic diagram of the illumination system of a first preferred embodiment of the present invention.
Figure 3:
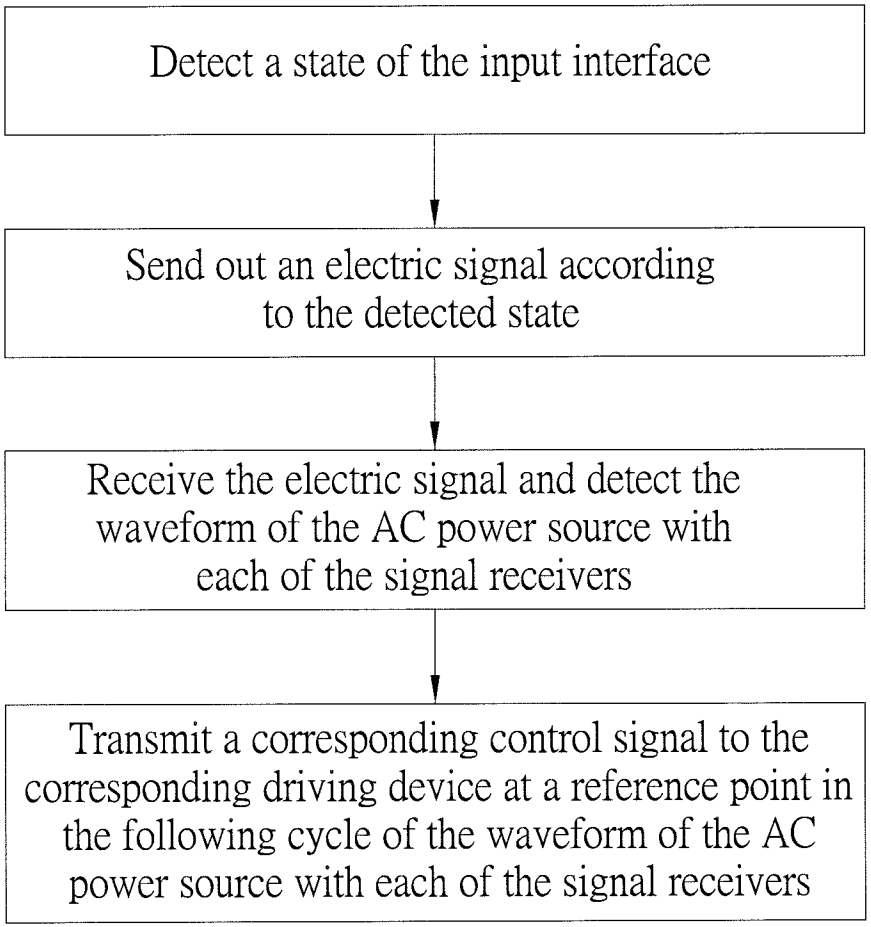
FIG. 3 is a flow chart of the first preferred embodiment of the present invention.

As shown in FIG. 1, an illumination system 1 of the first preferred embodiment of the present invention includes an input interface 10, a signal transmitter 12, a plurality of driving devices 14, a plurality of lamps which are light-emitting diode (LED) modules 16 as an example, and a plurality of signal receiver 18. Hereafter, the illumination system 1 is taken to explain a method of controlling multiple lamps of the first preferred embodiment shown in FIG. 3.

The input interface 10 includes a switch 102 and a push button switch 104. The push button switch 104 is normally-open; in other words, the push button switch 104 is short only when pressed.

The signal transmitter 12 is electrically connected to an AC (alternative current) power source S through the switch 102, while the signal transmitter 12 is electrically connected to the push button switch 104. The switch 102 is controlled to allow or disallow electricity to flow to the signal transmitter 12. The signal transmitter 12 changes a waveform of the AC power source S when the push button switch 104 is pressed and therefore short; specifically, each positive half wave of the waveform of the AC power source S is changed to have a delay angle. On the contrast, when the push button switch 104 is not pressed, it automatically returns to an open state, and the signal transmitter 12 does not change the waveform of the AC power source S; in other words, the waveform outputted by the signal transmitter 12 has no delay angle therein. In order to decrease harmonic of the AC power source S, and to avoid reducing too much power factor, the delay angle is preferably less than or equal to 90 degrees. The waveform of the AC power source S which contains the delay angles can be transmitted as an electric signal.

Figure 2A:
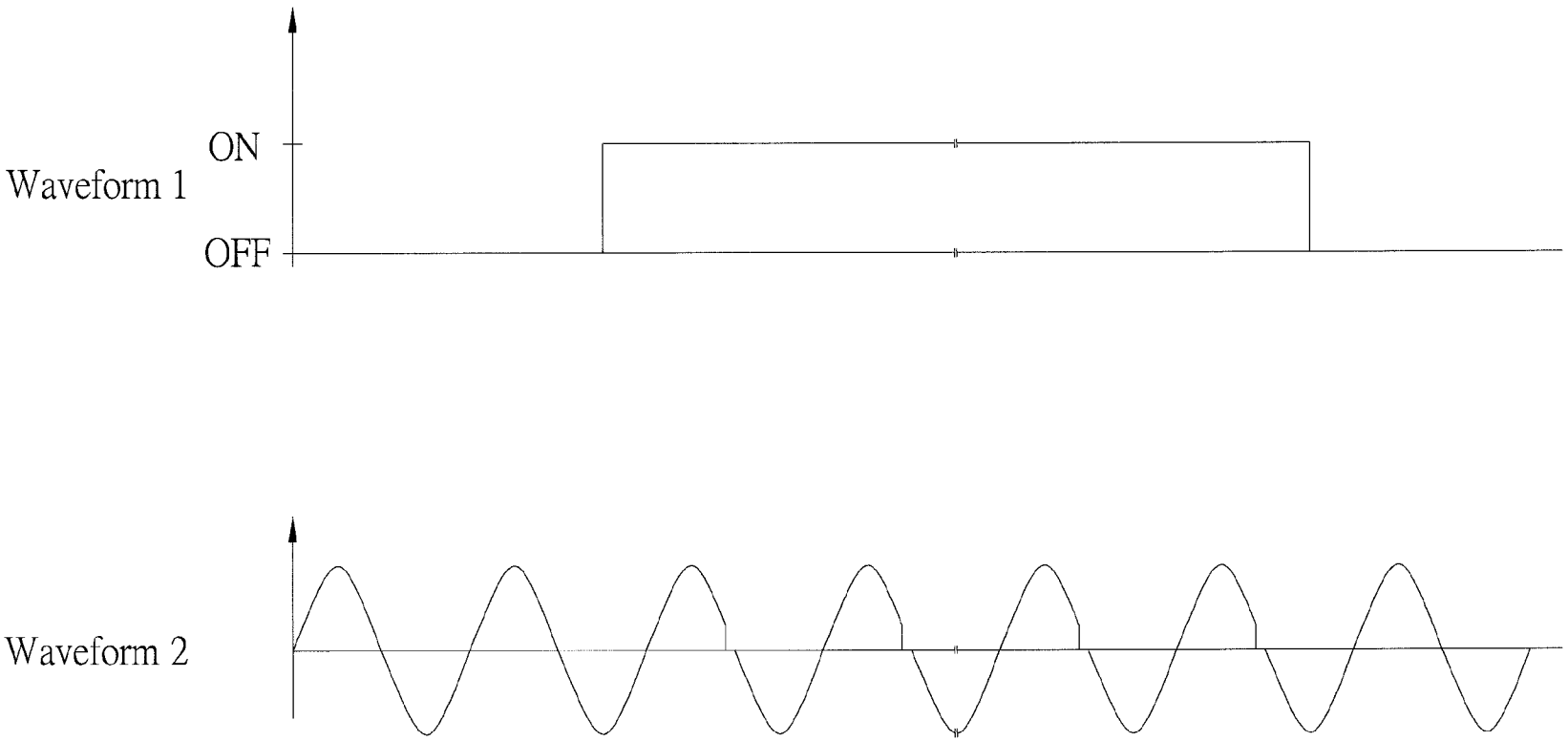
FIG. 2A is an oscillogram showing that each positive half wave has the delay angle at where the waveform approaching the zero crossing when the switch is conducted.
Figure 2B:
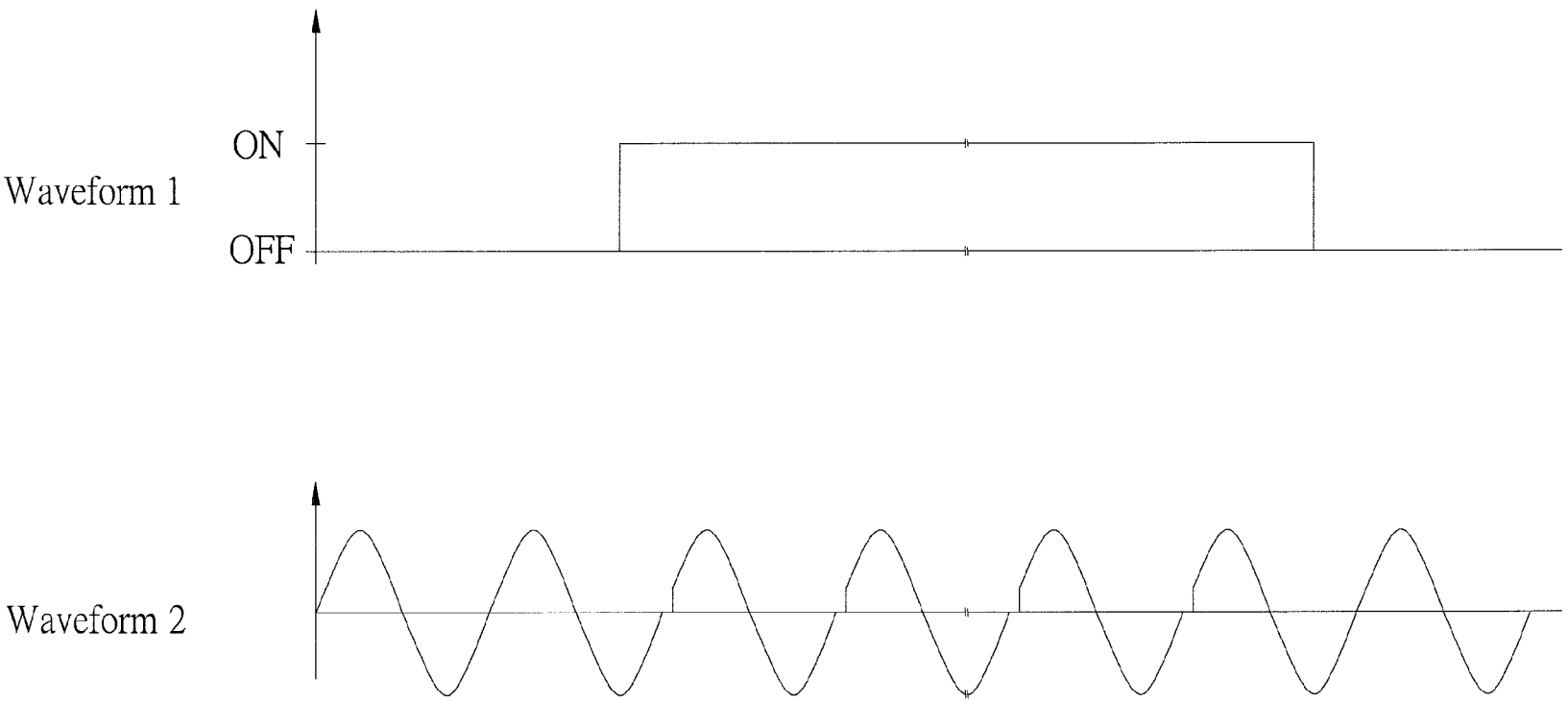
FIG. 2B is an oscillogram showing that each positive half wave has the delay angle at where the waveform leaving the zero crossing when the switch is conducted.

In the first preferred embodiment, when the push button switch 104 is pressed (as waveform 1 shown in FIG. 2A), the signal transmitter 12 changes the waveform of the AC power source S to make each positive half wave of the outputted voltage waveform have the delay angle at where the waveform approaching the zero-crossing (as waveform 2 shown in FIG. 2A). In practice, the delay angel can be alternatively arranged to locate at where the waveform leaving the zero-crossing, as shown in FIG. 2B. Of course, the delay angle can be located at any position on the waveform, including negative half waves, as long as the push button switch 104 can be recognized as being pressed through the delay angles contained in the waveform.

The driving devices 14 are all electrically connected to the signal transmitter 12 and the AC power source S, while the LED modules 16 are respectively electrically connected to each of the driving devices 14. Each of the LED modules 16 has a plurality of LEDs for using the electricity which flows from the connected driving device 14 to emit light. Each of the driving devices 14 converts the electricity which flows from the signal transmitter 12 to the electricity required by each of the LED modules 16. Each of the driving devices 14 can controllably turn on/off the connected LED 16, or change a luminance thereof. In the first preferred embodiment, each of the driving devices 14 is designed based on a pulse width modulation (PWM) circuit, wherein a clock pulse width of the electric signal provided to each of the LED module 16 can be modulated. In practice, the driving devices 14 can be, of course, based on different circuit designs which are able to regulate voltage or adjust electricity.

Each of the signal receivers 18 includes a phase angle detection circuit 182 and a processor 184, wherein the phase angle detection circuit 182 is electrically connected to the signal transmitter 12 to detect the waveform of the electricity which flows from the signal transmitter 12. The delay angles are measured if detected, and the result of measurement is transmitted to the processor 184.

Each of the processors 184 can be switched between a plurality of control modes including a maximum illumination mode, a default illumination mode, and a luminance adjusting mode. When under different control mode, the electricity outputted from the corresponding driving device 14 varies to make the connected LED module 16 have different reactions. As mentioned above, if the push button switch 104 is pressed, the waveform of the electricity which flows from the signal transmitter 12 has the delay angles therein, and therefore the delay angels can be used as an indication showing whether the push button switch is pressed or not. In light of this, each of the processors 184 can be switched to different control mode by pressing the push button switch 104, for the phase angle detection circuit 182 is in charge of detecting and measuring the delay angles. The cycle of the AC power source S can be obtained through the waveform detected by each of the phase angle detection circuits 182, and the processors 184 can define an "all-agreed" reference point in each cycle of the AC power source S. With the reference point, the processors are able to control the driving devices 14 simultaneously. In the first preferred embodiment, the reference point is the first zero crossing in each cycle, and each of the processors 184 sends out a control signal to the corresponding driving device 14 at each reference point, and therefore each of the LED modules 16 can be operated in this way to perform reactions such as turning on, turning off, changing luminance, etc. In practice, the peak of each cycle can be defined as the reference point, which of course has the same effect of synchronization.

Hereafter, one of the processors 184 and its corresponding driving device 14 are taken for example to explain the control modes.

Under the maximum illumination mode, the processor 184 sends out the control signal to the driving device 14 at the reference point in the following cycle of the waveform of the AC power source S, and then the driving device 14 accordingly drives the LED module 16 to emit light with a maximum luminance under a rated power thereof.

Under the default illumination mode, the processor 184 sends out the control signal to the driving device 14 at the reference point in the following cycle of the waveform of the AC power source S, and then the driving device 14 accordingly drives the LED module 16 to emit light with a default luminance. In the first preferred embodiment, the default luminance is originally defined as half of the maximum luminance, and can be updated (modified) under the luminance adjusting mode.

Under the luminance adjusting mode, the processor 184 controls the driving device 14 to drive the LED module 16 to emit light with a changing luminance which is repeatedly and continuously changing between a first luminance and a second luminance. In more details, the processor 184 controls the driving device 14 to make the changing luminance increase or decrease with a luminance difference at the reference point in each cycle of the waveform of the AC power source S, until the push button switch 104 is no longer pressed, which can be realized since the delay angles would disappear. Once the push button switch 104 is released, the changing luminance at the moment is recorded to replace the default luminance under the default illumination mode, and then the LED module 16 is driven to emit light with the updated default luminance. In the first preferred embodiment, the first luminance is the maximum luminance, and the second luminance is a minimum luminance. Whereby, the luminance of the LED module 16 can be changed between the maximum and the minimum luminance when the processor 184 is under the luminance adjusting mode.

In practice, the changing luminance of the LED module 16 can be initially increased or decreased from a third luminance between the first and the second luminance, wherein the third luminance can be set as half of the maximum luminance. So, when the processor 184 is switched to the luminance adjusting mode, the luminance is not changed too much, which reduces eye irritation. In addition, there can be more than 1 reference point defined in each cycle of the waveform of the AC power source S, such as two zero crossings or two peaks, for the changing luminance to be increased or decreased with the luminance difference.

When the switch 102 is conducted to allow the electricity from the AC power source S to flow to the illumination system, the processor 184 is under the maximum illumination mode by default; in other words, the LED module 16 emits light with the maximum luminance.

Since each cycle of the waveform of the electricity flows from the signal transmitter 12 has the delay angle therein while the push button switch 104 is pressed, it can be used as a timing unit, and the processor 184 can therefore estimate a pressed time for the push button switch. Length of the pressed time can be used as a command in the electric signal. For example, if the pressed time is shorter than a predetermined time (1.2 seconds in the first preferred embodiment), it is seen as a switching command; otherwise, it is seen as a luminance adjusting command.

If the processor 184 finds out that the electric signal detected by the phase angle detection circuit 182 contains the switching command, it is switched to the default illumination mode at the reference point in the following cycle of the waveform of the AC power source S. After receiving the switching command one more time, the processor 184 controls the driving device 14 to stop providing the electricity to the LED module 16 at the reference point in the cycle of the waveform of the AC power source S, and therefore the LED module 16 is turned off. If the processor 184 receives the switching command again, it is switched to the maximum illumination mode at the reference point in the following cycle of the waveform of the AC power source S, and so on.

If the processor 184 finds out that the electric signal detected by the phase angle detection circuit 182 contains the luminance adjusting command, it is switched to the luminance adjusting mode at the reference point in the following cycle of the waveform of the AC power source S to change the default luminance. Under the luminance adjusting mode, the changing luminance is stopped changing once the push button switch 104 is released, which is defined as a stop command.

To apply the illumination system 1 to a building, the input interface 10 and the signal transmitter 12 can be installed on a wall of the building (i.e., a control terminal), while the signal receivers 18, the driving devices 14, and the LED modules 16 installed on a wall or a ceiling of the building (i.e., a load terminal). In this way, it only takes two wires which connected to the AC power source S to connect the signal transmitter 12 and each signal receiver 18, which means, the conventional wiring of the building is compatible to transmit the waveform, which indicates whether the push button switch 104 is pressed or not, to each of the signal receivers 18.

Each of the signal receiver 18 sends out the corresponding control signal to each of the driving device 14 depending on the pressed time of the push button switch 104, and furthermore, the control signal is sent out at the same time point (the reference point in one of the cycles of the waveform of the AC power source S) to control each of the LED modules 16, so the multiple lamps can be controlled simultaneously. Especially when the processors 184 are under the luminance adjusting mode, with longer time or more times of luminance changing, the luminance between the LED modules may become obviously different in lack of such synchronization mechanism.

In practice, each of the LED modules 16 can include a plurality of first LEDs and a plurality of second LEDs, wherein the first LEDs and the second LEDs have different light colors. For example, the light color of the first LEDs is cool, such as white or blue, and the light color of the second LEDs is warm, such as yellow or red.

Each of the driving devices 14 can respectively control a luminance ratio of the corresponding first and second LEDs to change a total color temperature of the LED module 16, wherein the luminance ratio of the first LEDs is the ratio of the luminance thereof to the maximum luminance or the default luminance, and the luminance ratio of the second LEDs is in the same sense.

Among the control modes of the processors 184, the maximum illumination mode includes a first illumination ratio information, which records the luminance ratio of the first and the second LEDs when under the maximum illumination mode. Similarly, the default illumination mode includes a second illumination ratio information, which records the luminance ratio of the first and the second LEDs when under the default illumination mode.

The control modes further includes a light temperature adjusting mode, which is used to adjust the first or the second illumination ratio information. When the processor 184 is under the maximum illumination mode or the default illumination mode, it can be switched to the light temperature adjusting mode by pressing the push button switch 104 longer than a setting time (4 seconds in the preferred embodiment). Specifically, if the push button switch is pressed for longer than the setting time, it is defined as a light temperature adjusting command. If the processor 184 finds out that the electric signal contains the light temperature adjusting command, it is switched to the light temperature adjusting mode at the reference point in the following cycle of the waveform of the AC power source S.

Under the light temperature adjusting mode, each of the driving device 14 is controlled to drive each of the LED modules 16 to emit light, and the luminance ratio of the first LEDs and the second LEDs are repeatedly and continuously changed without altering a total luminance (i.e., the maximum luminance or the default luminance); at the reference point in each cycle of the waveform of the AC power source S, the luminance ratio is increased or decreased with a luminance ratio difference, until the push button switch 104 is no longer pressed, which can be realized since the delay angles would disappear. Once the push button switch 104 is released, the luminance ratio of the first and the second LEDs at the moment is recorded to replace the first illumination ratio information of the maximum illumination mode or the second illumination ratio information of the default illumination mode, and then the first and the second LEDs are driven to omit light according to the updated first or second illumination ratio information. The difference of the luminance ratio between the LED modules 16 can be also prevented by referring to the reference point in each cycle of the waveform of the AC power source S.

The waveform of the AC power source S is taken as the electric signal in the first preferred embodiment to indicate whether the push button switch 104 is pressed and for how long. However, there is an alternative way to perform the same function of synchronization.

Figure 4:
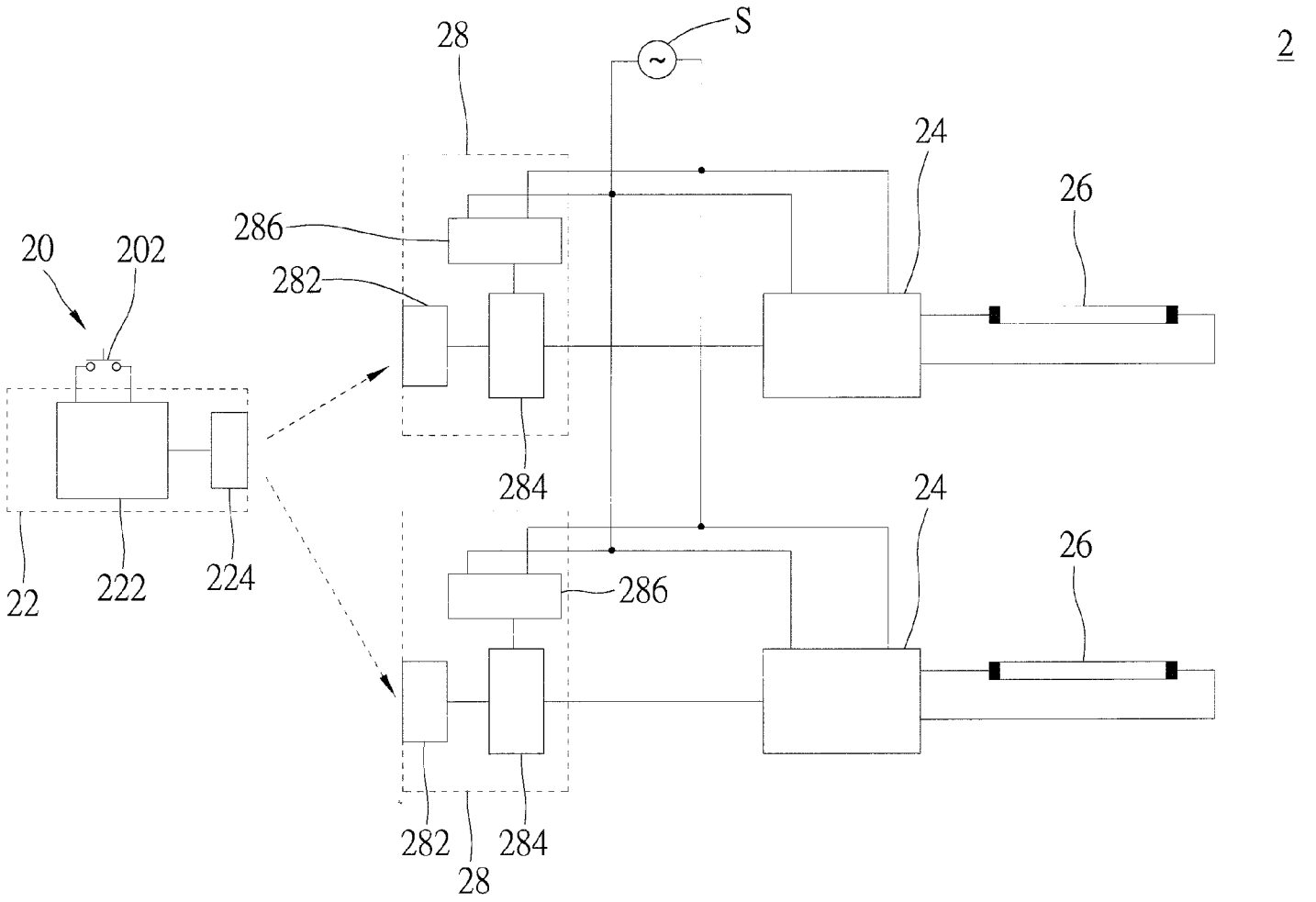
FIG. 4 is a schematic diagram of the illumination system of a second preferred embodiment of the present invention.

As shown in FIG. 4, an illumination system 2 applied with a method of controlling multiple lamps of the second preferred embodiment has basically the same structure as the first preferred embodiment, including an input interface 20, a signal transmitter 22, a plurality of driving devices 24, a plurality of lamps which are fluorescent lamps 26 as an example, and a plurality of signal receivers 28.

The input interface 20 includes a push button switch 202, and the signal transmitter 22 includes a controller 222 and a wireless signal transmitting device 224. The controller 222 detects whether the push button switch 202 is pressed, and accordingly generates a wireless signal which contains a command (the switching command, the luminance adjusting command, or the stop command). The wireless signal is sent out through the wireless signal transmitting device 224

The driving devices 24 are electrically connected to an AC power source S together, and are respectively connected to each of the fluorescent lamps 26. In the second preferred embodiment, the driving devices 24 are dimmable ballasts, which controllably regulate the electricity provide to the fluorescent lamps 26 to turn them on or off, or to adjust luminance thereof.

Each of the signal receivers 28 includes a wireless signal receiving device 282, a processor 284, and a waveform detection circuit 286. Each of the wireless signal receiving devices 282 receives the wireless signal sent from the signal transmitter 22, and transfers the received wireless signal to the corresponding processor 284. The waveform detection circuits 286 are electrically connected to the AC power source S together to detect the waveform of the AC power source S. The result of detection is transferred to the processors 284, whereby each of the processors 284 can perform synchronized operation based on the reference point in each cycle of the waveform of the AC power source S.

Each of the processors 284 is electrically connected to one of the driving devices 24, wherein each of the processor 284 can also be switched between a plurality of control modes, which includes the maximum illumination mode, the default illumination mode, and the luminance adjusting mode. The operation under each control mode is the same with what described in the first preferred embodiment, except that the driving devices 24 are different, so the operation is not described in detail herein because it is not the focus of the present invention. Similarly, the processors 284 sends out the control signal to the driving devices 24 at the reference point in one of the cycles of the waveform of the AC power source S. Whereby, the operation of the fluorescent lamps 26 is synchronized, and the luminance thereof is effectively guaranteed to be the same with each other.

In summary, the method of controlling multiple lamps provided in the present invention takes the waveform of the AC power source S as the basis for synchronization, which ensures that all signal receivers transmit control signals to the driving devices at the same time point every time, and therefore the lamps are operated simultaneously.

In addition, the lamps adopted in the illumination system can be other kinds other than LED modules and fluorescent lamps. Though different kinds of lamps may require different kinds of driving devices, they are still compatible to apply with the method provided in the present invention.

It must be pointed out that the embodiments described above are only some preferred embodiments of the present invention. All equivalent methods which employ the concepts disclosed in this specification and the appended claims should fall within the scope of the present invention.

What is claimed is:

1. A method of controlling multiple lamps, which is applied to an illumination system including an input interface, a signal transmitter, a plurality of signal receivers, a plurality of driving devices, and a plurality of lamps, wherein the signal transmitter is electrically connected to the input interface, and communicates with the signal receivers; the signal receivers are electrically connected to an AC power source, and each of the signal receivers are electrically connected to each of the driving devices and each of the lamps one by one; the method comprising the steps of:

A. detecting a state of the input interface with the signal transmitter;

B. transmitting a signal according to the detected state of the input interface from the signal transmitter to the signal receivers; and C. receiving the signal and detecting a waveform of the AC power source with each of the signal receivers, and then transmitting a corresponding control signal to the corresponding driving device at a reference point in a cycle of the waveform of the AC power source, wherein each of the driving devices controls the corresponding lamps accordingly, and the reference point in each cycle of the waveform of the AC power source is the same.

2. The method of claim 1, wherein the reference point is a zero crossing of each cycle of the waveform detected by the signal receivers.

3. The method of claim 1, wherein the reference point is a peak of each cycle of the waveform detected by the signal receivers.

4. The method of claim 1, wherein the signal transmitter communicates with the signal receivers wirelessly.

5. The method of claim 1, wherein the signal transmitter is electrically connected to the AC power source, while the signal receivers are electrically connected to the signal transmitter; according to the detected state of the input interface, the signal transmitter changes the waveform of the AC power source to make one of half cycles of the waveform have a delay angle, and the waveform of the AC power source which has the delay angle is the signal; each of the signal receivers receives electricity flows from the signal transmitter, and when each of the signal receivers determines that the waveform of the electricity has the delay angle, the control signal is accordingly transmitted to the corresponding driving device to control the corresponding lamp.

6. The method of claim 5, wherein the input interface includes a push button switch; the state of the input interface indicates whether the push button switch is pressed or not; when the push button switch is pressed, the signal transmitter changes the waveform of the AC power source to make the waveform have the delay angle.

7. The method of claim 1, wherein when each of the signal receivers determines that the signal includes an luminance adjusting command, the corresponding driving device is controlled to repeatedly and continuously change a luminance of the corresponding lamp between a first luminance and a second luminance; each of the signal receivers controls the corresponding driving device to increase or decrease the luminance of the corresponding lamp with a luminance difference at the reference point in each cycle of the waveform of the AC power source.

8. The method of claim 7, further comprising a step of stopping changing the luminance of each of the lamps when the corresponding signal receiver determines that the signal includes a stop command, wherein the luminance of each of the lamps at the moment is recorded, and then the lamps are respectively driven to emit light with the corresponding recorded luminance.

9. The method of claim 7, wherein when each of the signal receivers determines that the signal includes a luminance adjusting command, each of the signal receivers controls the corresponding driving device to initially change the luminance of the corresponding lamp from a third luminance which is between the first and the second luminance.

* * * * *